US009028146B2

(12) United States Patent
Brimson

(10) Patent No.: US 9,028,146 B2
(45) Date of Patent: May 12, 2015

(54) CONNECTION ASSEMBLY

(75) Inventor: Michael R. Brimson, Selston (GB)

(73) Assignee: Ezi-Dock Systems Limited, Manchester (GB)

( * ) Notice: Subject to any disclaimer, the term of this patent is extended or adjusted under 35 U.S.C. 154(b) by 571 days.

(21) Appl. No.: 11/970,399

(22) Filed: Jan. 7, 2008

(65) Prior Publication Data

US 2008/0174113 A1 Jul. 24, 2008

Related U.S. Application Data

(63) Continuation of application No. 11/748,926, filed on May 15, 2007, now abandoned, which is a continuation of application No. 10/567,989, filed as application No. PCT/GB2004/003457 on Aug. 11, 2004, now abandoned.

(30) Foreign Application Priority Data

Aug. 11, 2003 (GB) ..... 0318746.5
Mar. 29, 2004 (GB) ..... 0407005.8

(51) Int. Cl.

| | |
|---|---|
| ***B65D 33/00*** | (2006.01) |
| ***B65D 33/02*** | (2006.01) |
| ***B65D 45/00*** | (2006.01) |
| ***B65D 45/32*** | (2006.01) |
| ***B65D 45/34*** | (2006.01) |
| ***B65B 67/04*** | (2006.01) |
| ***B65D 88/16*** | (2006.01) |

(52) U.S. Cl.
CPC ..... *B65D 88/1668* (2013.01); *B65D 88/1618* (2013.01)

(58) Field of Classification Search
CPC ..... B65B 67/1222; B65B 67/1233; B65B 67/1238
USPC ..... 220/315, 319, 320, 321; 285/368; 383/33, 34; 248/99, 101
See application file for complete search history.

(56) References Cited

U.S. PATENT DOCUMENTS 2,001,475 A * 5/1935 Vogt ..... 426/108
2,145,613 A * 1/1939 Shenk et al. ..... 220/495.11

(Continued)

FOREIGN PATENT DOCUMENTS

BE 552325 A 11/1956
DE 19608110 9/1997

(Continued)

OTHER PUBLICATIONS

PCT International Search Report Application No. PCT/GB 2004/003457; International Filing Date Aug. 11, 2004; Applicant is EZI-Dock Systems Limited.

(Continued)

*Primary Examiner* — Fenn Mathew
*Assistant Examiner* — Andrew T Kirsch
(74) *Attorney, Agent, or Firm* — Howard & Howard Attorneys PLLC

(57) ABSTRACT

A connection assembly for connection to the mouth of a flexible container comprising of an inner ring having an inner flange around its external diameter and an outer ring having a recess around its inner diameter sized to engage the inner flange. The inner and outer rings being adapted to interengage to trap the mouth between the inner and outer rings.

15 Claims, 3 Drawing Sheets

(56) References Cited

U.S. PATENT DOCUMENTS

| | | | | | |
|---|---|---|---|---|---|
| 3,779,419 | A | * | 12/1973 | Heitz | 220/495.11 |
| 4,111,457 | A | * | 9/1978 | Kob et al. | 280/728.2 |
| 4,488,697 | A | * | 12/1984 | Garvey | 248/101 |
| 4,530,525 | A | | 7/1985 | Schneider | |
| 4,550,440 | A | * | 10/1985 | Rico | 383/33 |
| 5,308,110 | A | * | 5/1994 | Kokeguchi | 280/728.2 |
| 5,558,137 | A | | 9/1996 | Futerman | |
| 5,588,622 | A | | 12/1996 | Gordon, Sr. | |
| 5,882,119 | A | * | 3/1999 | Fadal, II | 383/80 |
| 5,964,368 | A | * | 10/1999 | Schramm | 220/320 |
| 6,086,022 | A | * | 7/2000 | Dalton | 248/99 |
| 2001/0017303 | A1 | | 8/2001 | McKenzie et al. | |

FOREIGN PATENT DOCUMENTS

| | | | |
|---|---|---|---|
| DE | 19608110 | A1 | 9/1997 |
| FR | 552325 | | 11/1956 |
| GB | 2039842 | | 0/1908 |
| WO | 2005016789 | | 2/2005 |

OTHER PUBLICATIONS

English language abstract for DE19608110 extracted from espacenet.com, Aug. 25, 2008.

* cited by examiner

CONNECTION ASSEMBLY

CROSS-REFERENCE TO RELATED APPLICATIONS

The subject patent application is a continuation of co-pending U.S. patent application Ser. No. 11/748,926, filed on May 15, 2007 with the U.S. Patent & Trademark Office, which is a continuation of U.S. patent application Ser. No. 10/567,989, filed on Feb. 10, 2006 with the U.S. Patent & Trademark Office, which claims priority to and all the benefits of International Application No. PCT/GB2004/003457, filed on Aug. 11, 2004 with the World Intellectual Property Organization, which in turn claims priority to United Kingdom Patent Application Nos. 0318746.5, filed on Aug. 11, 2003, and 0407005.8, filed on Mar. 29, 2004.

The present invention relates to a connection assembly for a flexible container. It also relates to a flexible container including the connection assembly.

Flexible containers are used in a wide variety of applications, from small 5 kg loads of, for example pharmaceutical products, to loads in excess of 30,000 kg of, for example plastic granules and dry powdered or granular food production.

There is often difficulty when connecting the flexible containers to apparatus for filling and/or emptying them. In particular, it is desirable to create a tight seal to limit contamination of the contents from the environment, and likewise to limit the escape of the contents into the environment during the filling and/or emptying operation.

One way to create a tight seal is to weld a single ring around the opening of the container. This ring then forms a rigid connector which can be attached to a filling and or emptying apparatus. However, it is difficult and time consuming to achieve an accurate welded fitting of a single ring, and welding may not be suitable for all container materials.

In view of this the present invention provides a connection assembly with a multipart construction for a flexible container, allowing simple attachment of the connection assembly to the flexible container.

According to a first aspect of the invention, there is provided a connection assembly for connection to the mouth of a flexible container, the connection assembly comprising:

- an inner ring having an inner flange around its external diameter;
- an outer ring having a recess around its inner diameter sized to engage the inner flange; and
- the inner and outer rings being adapted to interengage to trap the mouth between the inner and outer rings.

The term "ring" is used encompass all members which delimit an internal diameter. Thus it includes in its scope elliptical and circular members, as well as square, rectangular and polygonal members.

According to this construction a rigid connection assembly can be simply and easily attached to a flexible container. The use of several parts to form the connection simplifies attachment to a container, unlike previous systems which were welded directly to the container. The connection assembly can form a high quality seal with the container and is particularly suitable for use with containers carrying dry bulk materials.

The inner ring can be adapted to snap fit into engagement with the outer ring.

Preferably, the outer ring has an outer flange around its external diameter, the connection assembly further comprising a sealing ring sized to abut the inner and outer flange.

The assembly can further comprise a clamping ring for clamping the outer ring and the sealing ring together. This allows an easily detachable connection of the sealing flange and the outer flange. The clamping ring may have at least two parts hinged for relative movement, and a clamping mechanism for clamping the at least two parts together. The parts can be hinged so that clamping mechanism clamps radially (i.e. in the plane of the ring) or vertically (i.e. normal to the plane of ring).

Preferably, the apparatus may further comprise means to accurately position the sealing ring relative to the inner and outer rings. This further simplifies assembly. This may be achieved by an assembly in which the inner ring has a guiding recess on its inner diameter and the sealing ring has a guiding projection on its inner diameter, such that the guiding projection is located in the guiding recess to accurately position the sealing ring.

Preferably, the apparatus may further comprise an O ring positioned between the inner flange and the recess. This allows a more effective seal.

Preferably, the apparatus may further comprise a lip on the outer flange. This allows a more effective seal. The lip can have the form of, for example, an O ring. The O ring can be formed in a single piece together with the outer ring, i.e. as an integral part of the outer flange, or may be a separate part which is to form the lip and is bonded or otherwise attached to the outer flange.

Preferably, the assembly may further comprise a membrane at least over the aperture of the inner ring. Thus, when the assembly is in place with a container, the membrane will stop the contents of the container escaping through the aperture in the assembly and ingress of contaminants into the container.

According to a second aspect of the present invention, there is provided a flexible container having a connection assembly as described above in relation to the first aspect of the invention, wherein an opening of the container is delimited by the internal diameter of the inner ring, and the material of the container is folded over the inner ring such that it is trapped between the recess and the inner flange. Thus the assembly is securely attached to the container. The outer flange and the sealing flange can be clamped together or otherwise attached to ensure that the connection assembly remains in place.

The present invention will now be described by way of example only and not in any limitative sense with reference to the accompanying drawings in which.

Throughout the drawings, like reference numerals denote like parts.

Figure 1A:
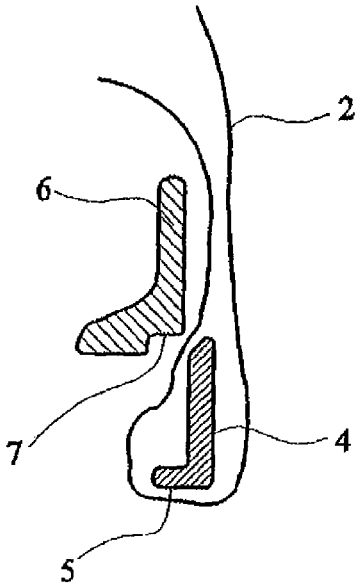
FIGS. 1A to 1C depict a cross section of a connection assembly according to a first embodiment of the present invention.
Figure 1B:
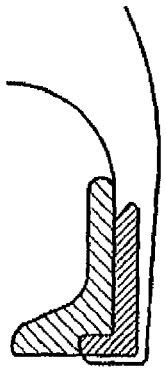

FIG. 1A depicts a connection assembly according to a first embodiment of the present invention, assembled in place on a flexible container 2. The flexible container 2 is wrapped around an inner ring 4. The inner ring 4 has a flange 5 on its external diameter which engages a corresponding recess 7 on an outer ring 6. The outer ring also has a flange 8 on its outer diameter. FIG. 1B depicts the inner ring 4 in place inside the outer ring 6, illustrating how the flexible container is trapped between the flange 5 and the recess 7.

Figure 1C:
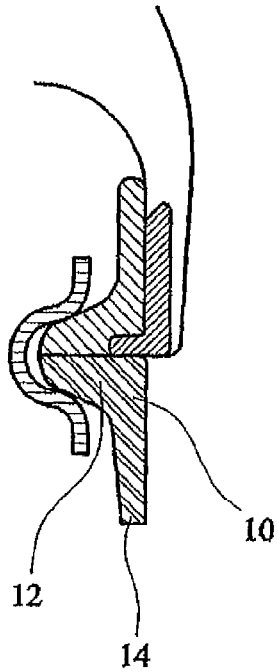

The final assembly is shown in FIG. 1C. A sealing ring 10 has a sealing flange 12 which abuts the flange 5 of the inner ring 4 and the flange 8 of the outer ring 6. A mechanical clamp is used to press the sealing flange 12 against the flange 8 of the outer ring 6. The flexible container is therefore securely attached to the connection assembly.

The sealing ring 10 incorporates a shank 14 for connection to other apparatus to fill or empty the container.

Figure 2A:
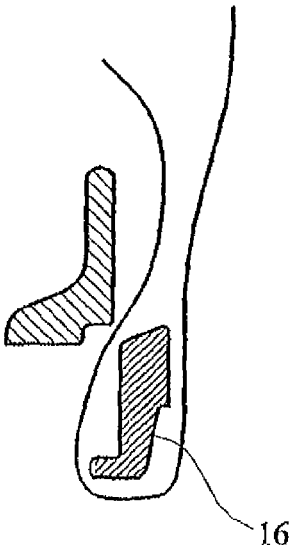
FIGS. 2A to 2C depict a cross section of a connection assembly according to a second embodiment of the present invention.
Figure 2B:
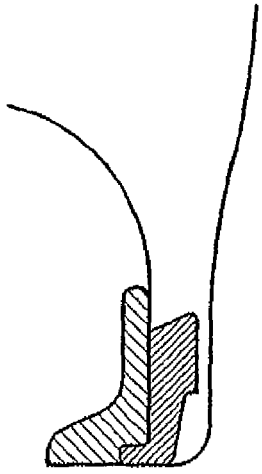
Figure 2C:
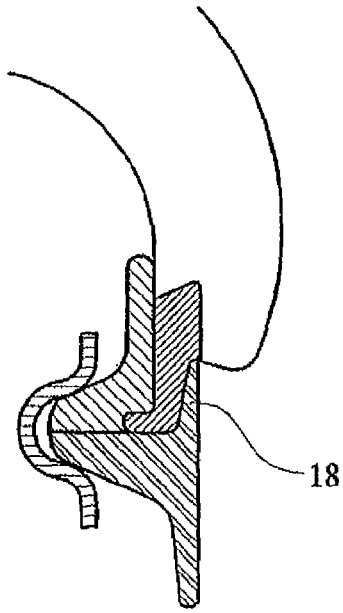
Figure 3D:
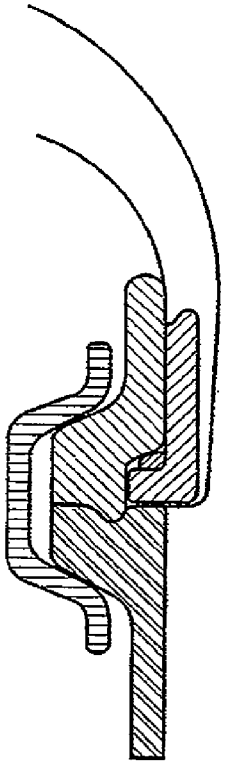
FIGS. 3A to 3D depict a cross section of a connection assembly according to a third embodiment of the present invention.
Figure 3C:
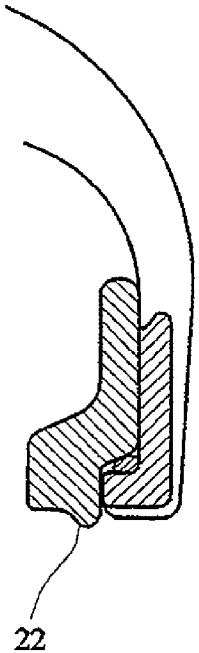
Figure 3B:
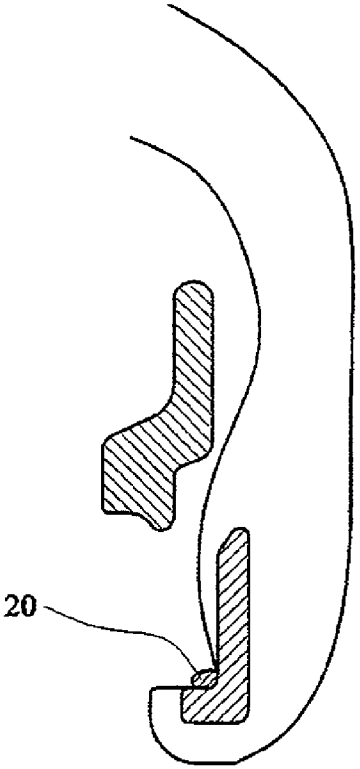
Figure 3A:
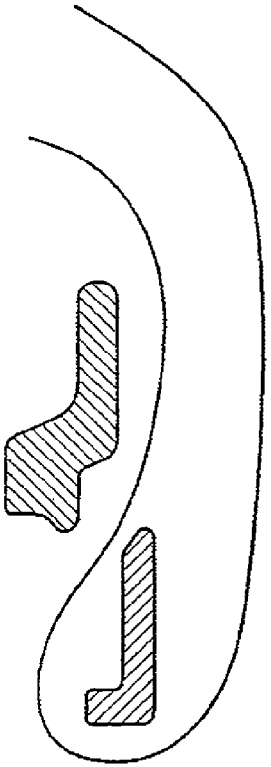
Figure 4A:
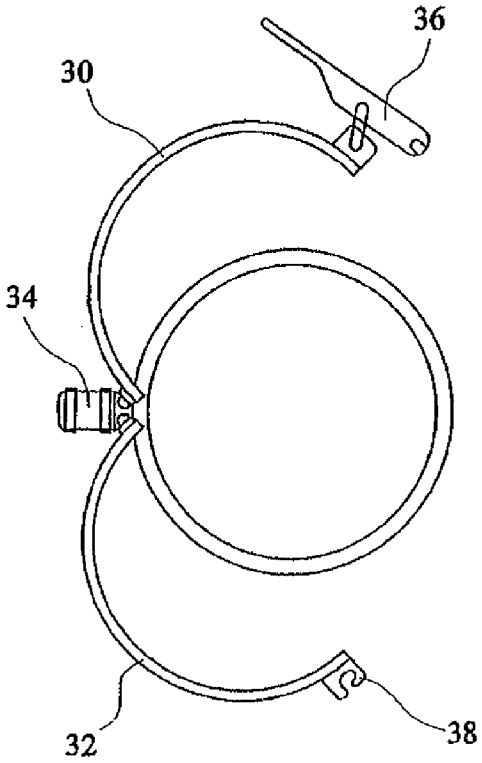
FIGS. 4A to 4D depict a plan view of a method of mechanically clamping the connection assembly according to the present invention.
Figure 4B:
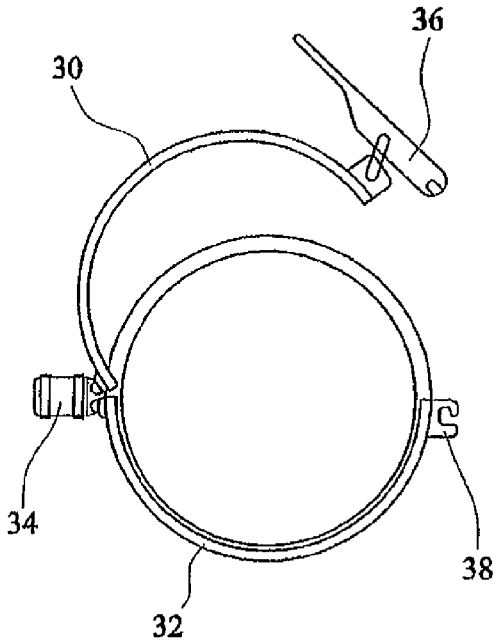
Figure 4C:
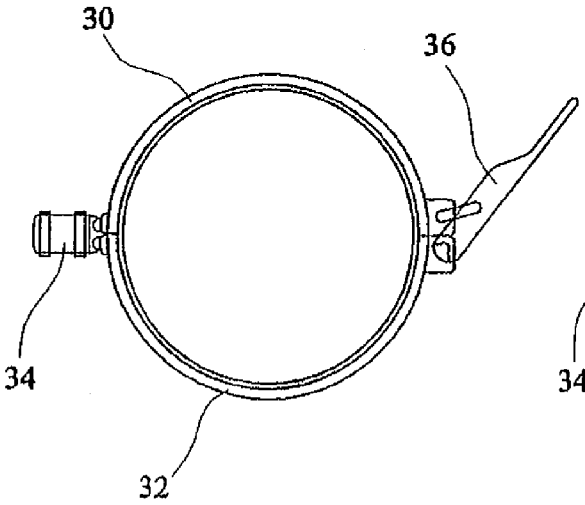
Figure 4D:
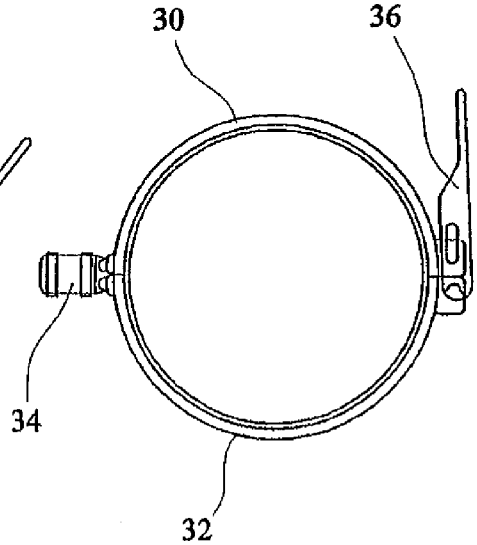

FIG. 2 depicts a second embodiment of the present invention. The construction of this embodiment is as for first, save as described below. This embodiment includes a guide recess 16 formed on the inner diameter of the inner ring. The sealing ring has a corresponding projection or spigot 18 which engages the recess 16. This ensures that the sealing ring is accurately located with respect to the inner and outer rings, simplifying the assembly process. It has the further benefit that the flexible container is located more securely within the connection assembly, and that the seal is improved.

FIG. 3 depicts a cross section of a third embodiment of the present invention. The construction of this embodiment is as for first, save as described below. In this embodiment two lips are provided to further improve the seal. One or both of these lips can be in the form of an O ring. FIG. 3 shows a removable O ring seal 20 located between the flange of the inner ring and the recess of the outer ring. An integral O ring seal 22 is also located on the outer ring to improve its seal with the sealing flange.

In this embodiment, the integral O ring seal 22 is formed in one piece with the outer ring. However it may also be formed as separate piece and bonded to the outer ring. Furthermore, it will be appreciated that in alternate embodiments, only one of the O ring seals, rather than two, may be provided.

In the above first to third embodiments and the inner ring, outer ring are constructed from plastics. However it will be appreciated that alternative materials, such as metal could be used in alternate embodiments.

FIG. 4A to 4D depicts an embodiment of a mechanical clamp for use with the connection assembly of the first to third embodiment. The clamp has a first piece 30 and a second piece 32 which are pivotally connected for relative movement in the plane of the rings by a hinge 34. The first piece 30 and the second piece 32 have a generally "V" shaped cross section, sized to enclose both the sealing flange and the outer flange within the "V". An over-centre clamp 36 is attached to the first piece 30 for engaging with a clamping surface 38 on the second piece 32.

In order to use the clamp the connection is assembly located as described above and the clamp is then located over the sealing ring and the outer ring and the clamp closed. This can be used to secure the connection assembly onto the container.

In another alternate embodiment the clamp can have a generally "C" shaped profile, sized to enclose both the sealing flange and the outer flange within the "C".

In an alternative embodiment (not illustrated) the outer ring is attached to the inner ring by welding. In this case a clamp is not required.

In an alternative embodiment, a membrane extends over the aperture of the inner ring, thereby retaining the contents in the container.

In all the above embodiments that various constituent parts of the assembly have been described as rings. However, it will be appreciated that the rings need be circular, and in alternate embodiments, the rings may be elliptical or polygonal.

The container of the embodiments may be a simple bag, or alternatively may be a liner of a bulk container, or any other container using a flexible, impermeable membrane. This includes, for example, a polyethylene bag, small powder handling bags, kegs, FIBCs (Big Bags), Octabins and ISO Container liners. The embodiments can easily be scaled for use with various sizes of container, from smaller 5 kg bags to containers carrying as much as 30,000 kg.

A method of emptying the container having the connection assembly will now be described. Typically, the container will have a restriction above the connection assembly, to ensure that its contents are not accidentally discharged. If a membrane is present in the connection assembly, it must first be torn to enable access to the contents.

A clamping mechanism is attached to the shank 14 of the sealing ring. This can be done mechanically, using the strength of the operator only, pneumatically, or driven by other means, such as a motor.

The restriction in the container is then released allowing the container contents to pass into an emptying volume of the apparatus. The emptying apparatus includes a vacuum pump in fluid communication with the seal. Once the majority of the product has fallen into the emptying volume the vacuum pump is used to remove the remaining traces of product from the container. The vacuum pump can also deflate the container making it easier to fold. Alternatively, a vacuum release valve may be present which is operative to prevent deflation or collapse of the container.

In one embodiment, the emptying apparatus includes a sharp edge to automatically pierce a membrane, if one is present.

This method allows easy emptying of the container. Because the container is wrapped over the inner ring, there is no tendency for the product to become caught in the connection assembly, and the product will not come into contact with the connection assembly.

The invention claimed is:

1. A connection assembly for connection to a mouth of a flexible container, the flexible container being filled with and/or emptied of a product through the mouth of the flexible container, the connection assembly comprising:

an inner ring, the inner ring having an inner ring internal perimeter and an inner ring external perimeter and having an inner flange extending continuously around the inner ring external perimeter;

an outer ring, the outer ring having an outer ring internal perimeter and an outer ring external perimeter and having an outer flange extending continuously around the outer ring external perimeter, and the outer ring having a recess extending therein and continuously around the outer ring internal perimeter, the recess being defined by surfaces of the outer ring;

wherein the inner flange around the inner ring external perimeter is received in the recess of the outer ring and the inner flange of the inner ring and the outer flange of the outer ring form an continuous surface defined by the exposed surface of the inner flange of the inner ring and the exposed surface of the outer flange of the outer ring;

the inner ring and outer ring being adapted to interengage to trap the mouth of the flexible container between the inner ring and outer ring;

the connection assembly further comprising a sealing ring, the sealing ring being provided with an abutting surface, the sealing ring being provided outside of the inner ring and outer ring, the sealing ring being sized for part of said abutment surface to abut the inner flange of the inner ring with the flexible container between the sealing ring and the inner ring and for another part of said abutment surface to abut the outer flange of the outer ring with the flexible container absent from between the sealing ring and the outer ring, said abutment surface of the sealing ring being configured to correspond to the continuous surface said abutment surface abuts, said continuous surface being defined by the exposed surface of the inner flange of the inner ring and the exposed surface of the outer flange of the outer ring;

wherein the flexible container is filled with and/or emptied of a product through the mouth of the flexible container with the sealing ring abutting the continuous surface being defined by the exposed surface of the inner flange of the inner ring and the exposed surface of the outer flange of the outer ring.

2. A connection assembly as claimed in claim 1, wherein the inner ring is adapted to snap fit into engagement with the outer ring.

3. A connection assembly as claimed in claim 1, further comprising a clamping ring for clamping the outer ring and sealing ring together.

4. A connection assembly as claimed in claim 3, wherein the clamping ring has at least two parts hinged for relative movement, and a clamping mechanism for clamping the at least two parts together.

5. A connection assembly as claimed in claim 1, wherein the sealing ring is provided with a guiding projection, and the inner ring has a guiding recess on its inner diameter adapted to abut the guiding projection on the sealing ring so as to accurately position said inner ring and said sealing ring.

6. A connection assembly as claimed in claim 1, further comprising an O ring positioned between the inner flange and the recess.

7. A connection assembly as claimed in claim 1, further comprising a lip on the outer flange.

8. A flexible container having a connection assembly as claimed in claim 1, wherein an opening of the container is delimited by the internal perimeter of the inner ring, and a material of the container is folded over the inner ring such that it is trapped between the recess and the inner flange.

9. A connection assembly as claimed in claim 1, wherein the inner ring and outer ring are both circular rings or both elliptical rings or both square rings or both rectangular rings or both polygonal rings.

10. A connection assembly as claimed in claim 1, wherein the inner ring is one of: a circular ring, an elliptical ring, a square ring, a rectangular ring or a polygonal ring.

11. A connection assembly as claimed in claim 1, wherein the outer ring is one of: a circular ring, an elliptical ring, a square ring, a rectangular ring or a polygonal ring.

12. A connection assembly as claimed in claim 1, wherein the sealing ring includes a sealing flange directly engaging the outer flange of the outer ring with the inner flange of the inner ring disposed in the recess such that the inner flange is sandwiched between the sealing ring and the outer ring.

13. A connection assembly for connection to a mouth of a flexible container, the connection assembly comprising:

an inner ring, the inner ring having an inner ring internal perimeter and an inner ring external perimeter and having an inner flange around the inner ring external perimeter;

an outer ring, the outer ring having an outer ring internal perimeter and an outer ring external perimeter and having an outer flange around the outer ring external perimeter, and the outer ring having surfaces extending therein and defining a recess around the outer ring internal perimeter, the inner flange of the inner ring having at least in part, a configuration complementary to the recess such that the inner flange is captured within the recess, wherein the inner flange of the inner ring and the outer flange of the outer ring form a continuous surface defined by the exposed surface of the inner flange of the inner ring and the exposed surface of the outer flange of the outer ring;

the inner ring and outer ring being adapted to interengage to trap the mouth of the flexible container between the inner ring and outer ring at the recess; and the connection assembly further comprising a sealing ring, the sealing ring disposed outside the inner and outer rings, the sealing ring being sized to abut the inner flange of the inner ring and the outer flange of the outer ring for sandwiching the flexible container between the inner flange and the sealing ring, wherein the flexible container is filled with and/or emptied of a product through the mouth of the flexible container with the sealing ring abutting the continuous surface being defined by the exposed surface of the inner flange of the inner ring and the exposed surface of the outer flange of the outer ring.

14. A connection assembly as claimed in claim 13, wherein the sealing ring includes a sealing flange directly engaging the outer flange of the outer ring with the inner flange of the inner ring disposed in the recess such that the inner flange is sandwiched between the sealing ring and the outer ring.

15. A connection assembly for connection to the mouth of a flexible container, the flexible container being filled with and/or emptied of a product through the mouth of the flexible container, the connection assembly comprising:

an inner ring, the inner ring having an inner ring internal perimeter and an inner ring external perimeter and having an inner flange extending around the inner ring external perimeter;

an outer ring, the outer ring having an outer ring internal perimeter and an outer ring external perimeter and having an outer flange extending around the outer ring external perimeter, and the outer ring having a recess extending therein and around the outer ring internal perimeter, the recess being defined by surfaces of the outer ring, wherein the inner flange around the inner ring external perimeter is received in the recess of the outer;

the inner ring and outer ring being adapted to interengage to trap the mouth of the flexible container between the inner ring and outer ring;

the connection assembly further comprising a sealing ring, the sealing ring being provided outside of the inner ring and outer ring, the sealing ring being sized to abut the inner flange of the inner ring with the flexible container between the sealing ring and the inner ring and to abut the outer flange of the outer ring with the flexible container absent from between the sealing ring and the outer ring, said sealing ring having an abutment portion, said abutment portion being configured to the exposed surface of the inner flange of the inner ring and the exposed surface of the outer flange of the outer ring;

wherein the flexible container is filled with and/or emptied of a product through the mouth of the flexible container with the sealing ring abutting the continuous surface being defined by the exposed surface of the inner flange of the inner ring and the exposed surface of the outer flange of the outer ring.

* * * * *